United States Patent [19]

Temburg et al.

[11] Patent Number: 4,748,725

[45] Date of Patent: Jun. 7, 1988

[54] OPENING DEVICE FOR DETACHING FIBER MATERIAL FROM COMPRESSED FIBER BALES

[75] Inventors: Josef Temburg, Jüchen; Ferdinand Leifeld, Kempen, both of Fed. Rep. of Germany

[73] Assignee: Trützschler GmbH & Co. KG, Monchen-Gladbach, Fed. Rep. of Germany

[21] Appl. No.: 101,862

[22] Filed: Sep. 25, 1987

[30] Foreign Application Priority Data

Oct. 11, 1986 [DE] Fed. Rep. of Germany ..... 3634709
Jul. 4, 1987 [DE] Fed. Rep. of Germany ..... 3722201

[51] Int. Cl.[4] ..... D01G 7/04; A01F 15/08
[52] U.S. Cl. ..... 19/80 R; 19/81
[58] Field of Search ..... 19/80 R, 81

[56] References Cited

U.S. PATENT DOCUMENTS

| | | | |
|---|---|---|---|
| 3,170,196 | 2/1965 | Denis | 19/80 R |
| 4,281,437 | 8/1981 | Marx | 19/80 R |
| 4,297,767 | 11/1981 | Leifeld | 19/80 R |
| 4,477,944 | 10/1984 | Binder | 19/80 R |
| 4,510,646 | 4/1985 | Locatelli et al. | 19/80 R |
| 4,586,217 | 5/1986 | Kranefeld | 19/80 R |
| 4,662,031 | 5/1987 | Feiks et al. | 19/80 R |
| 4,698,878 | 10/1987 | Büschgens | 19/80 R |

FOREIGN PATENT DOCUMENTS

| | | |
|---|---|---|
| 3334069 | 4/1986 | Fed. Rep. of Germany . |
| 964353 | 7/1964 | United Kingdom. |
| 2185759 | 7/1987 | United Kingdom. |

OTHER PUBLICATION 69847, published 5/1982, European—Pat. Off.

*Primary Examiner*—Louis K. Rimrodt
*Attorney, Agent, or Firm*—Spencer & Frank

[57] ABSTRACT

A travelling opening device for detaching fiber material from top faces of fiber bales includes two opening rollers having generally horizontal longitudinal axes oriented perpendicularly to a travelling direction of the opening device; opening elements carried on the opening rollers; and grates formed of grate bars spaced parallel to the longitudinal axes and each having a horizontal length portion arranged to engage the top faces of the fiber bales. The elements of the opening rollers project between the grate bars and penetrate into the fiber bales. Each opening roller cooperates with a separate grate. The grates are movably supported independently from one another. The grate bars of each grate have a supported end and an opposite free end spaced from the supported end parallel to the travelling direction. The free ends of the grate bars constitute an open end of the grate. The open ends of the two grates are adjacent and are oriented towards one another. The free end of each grate bar extends upwardly from the horizontal length portion, away from the top face of the bale during operation.

21 Claims, 4 Drawing Sheets

FIG.4
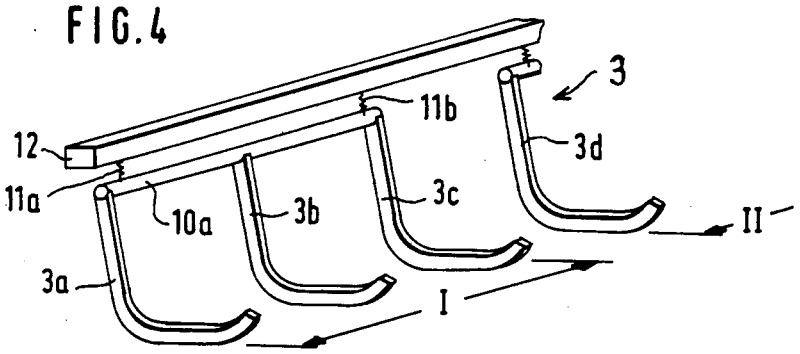
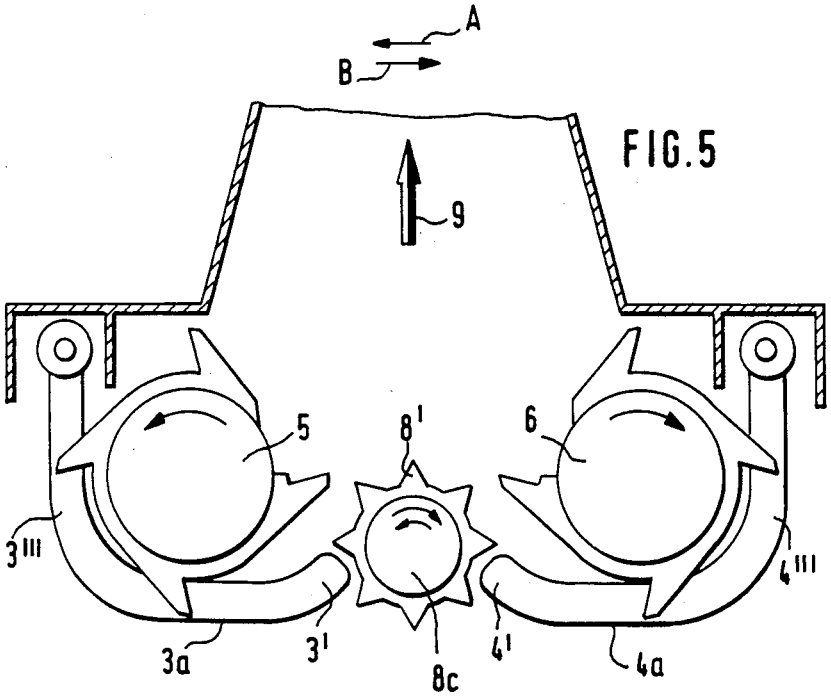
FIG.5

OPENING DEVICE FOR DETACHING FIBER MATERIAL FROM COMPRESSED FIBER BALES

BACKGROUND OF THE INVENTION

This invention relates to an opening device for detaching (opening) compressed fiber bales such as cotton bales, cellulose bales or the like, including rapidly rotating opening rollers provided with toothed opening disks or spikes which project through the spacings between the bars of a grate and penetrate into the bale surface as the opening rollers travel relative to the fiber bale surface.

In a known device as described in German Offenlegungsschrift (non-examined published patent application) No. 3,334,069, two opening rollers are provided and the grate bars have an offset course transversely to the direction of travel of the opening device, and at least one opening disk is provided behind and in front of the offset. It is a disadvantage of this arrangement that the force exerted by the offset (oblique) grate bar portions have a component directed to the bale surface which differs from the working direction.

SUMMARY OF THE INVENTION

It is an object of the invention to provide an opening device of the above-outlined type from which the discussed disadvantage is eliminated and with which the fiber detaching effect is significantly improved.

This object and others to become apparent as the specification progresses, are accomplished by the invention, according to which, briefly stated, each opening roller is associated with its own grate, and the open (free) end of the grate bars associated with the one and the other opening roller are oriented towards one another, and further, the open terminal region of the grate bars extend upwardly at an angle $\alpha$ from the surface of the fiber bales.

Thus, according to the invention, the grate bars are oriented in the direction of travel of the opening rollers. By virtue of the fact that the end zones of the grate bars oriented towards one another are open and are not, as in prior art arrangements, connected by means of an oblique offsetting portion, a force component attacking the bale face in a direction other than the direction of motion (working direction) is avoided. The fact that the open terminal zones of the grate bars extend upwardly at an angle to the bale face (that is, at an angle to the horizontal) has the advantage that the opening device may travel in two directions, and the open end of the grate which momentarily points in the working direction slides on the bale surface without getting caught therein.

According to an advantageous feature of the invention, the grate bars of the grates are offset with respect to one another relative to the direction of travel of the opening device. In this manner undesired mounds and furrows in the fiber bales, extending in the working direction, are avoided.

According to a further advantageous feature of the invention, the distance between the offset grate bars is approximately 100 mm measured perpendicularly to the direction of travel of the opening device.

According to a further advantageous feature of the invention the open ends of the grate bars are in a mutually overlapping relationship. Expediently, the distance of the ends of the grate bars in the overlapping arrangement is approximately 40 mm.

According to another advantageous feature of the invention, the angle between the end zones of the grate bars and the horizontal is approximately 35° to 45°.

According to still another advantageous feature of the invention the length of the substantially horizontal zone of the grate bars corresponds approximately to the diameter of the core of the opening roller and is thus approximately 50 to 70 mm. Such a diameter is the outer diameter of the entire opening roller assembly less the radial height of the teeth or spikes. Expediently, the open terminal zone of the grate bars has a length of approximately 60 to 80 mm Preferably, between the open ends of the grate bars a pressing roller is provided which cooperates with the upper face of the fiber bales. The roller presses on the upper face of the fiber bales and thus has a supporting and holdback function. This arrangement prevents the fiber bales from tipping over and furthermore prevents an undesirable shift in the top layers which are immobilized by the pressing roller. In particular, in the last remaining portions of the fiber bales, towards the end of the detaching operation, the opening rollers are prevented from grasping and picking up thicker residual layers, thus preventing the opening device from "choking". The pressing rollers are either driven or roll idly on the bale surface. If the pressing rollers are situated only between the ends of the grate bars, the outer boundary line of the grate bars may, on the opposite side, expediently extend in the close vicinity of the opening roller periphery so that the opening device may be moved in a vertical direction into gaps of the bale rows. This is the case, for example, when bales of unlike height are immediately adjoining. Preferably, the diameter of the pressing roller is approximately 100 to 150 mm. The pressing roller is provided with pins, teeth (for example, of star-shaped configuration), or the like. This ensures a more secure penetration into the bale surface.

According to a further feature of the invention, the open ends of the grate bars extend into the gaps between circumferential rows of pins or teeth of the pressing roller.

According to a further feature of the invention the grate bars are individually resiliently supported. According to another advantageous feature of the invention, each grate is individually resiliently mounted. According to still a further feature of the invention, each grate is provided with zones, each having a plurality of grate bars and each zone is spring-supported individually. Preferably, at least three grate zones are provided in which the shorter outer zones (edge zones) and the inside zone have springs of different hardness.

According to a further feature of the invention above the open ends of the grate bars there is provided a suction device for removing the detached fiber tufts by suction.

According to a further advantageous feature of the invention which includes at least two pressing rollers which are in contact with the surface of the fiber bales, the pressing rollers are in each instance arranged at that side of the grate which is remote from the open grate end, whereby the two pressing rollers together flank the two grates.

BRIEF DESCRIPTION OF THE DRAWINGS

FIG. 4 is a perspective view of some of the components of the construction of FIGS. 2 and 3.

FIG. 5 is a schematic side elevational view of another preferred embodiment of the invention.

DESCRIPTION OF THE PREFERRED EMBODIMENTS

Figure 1:
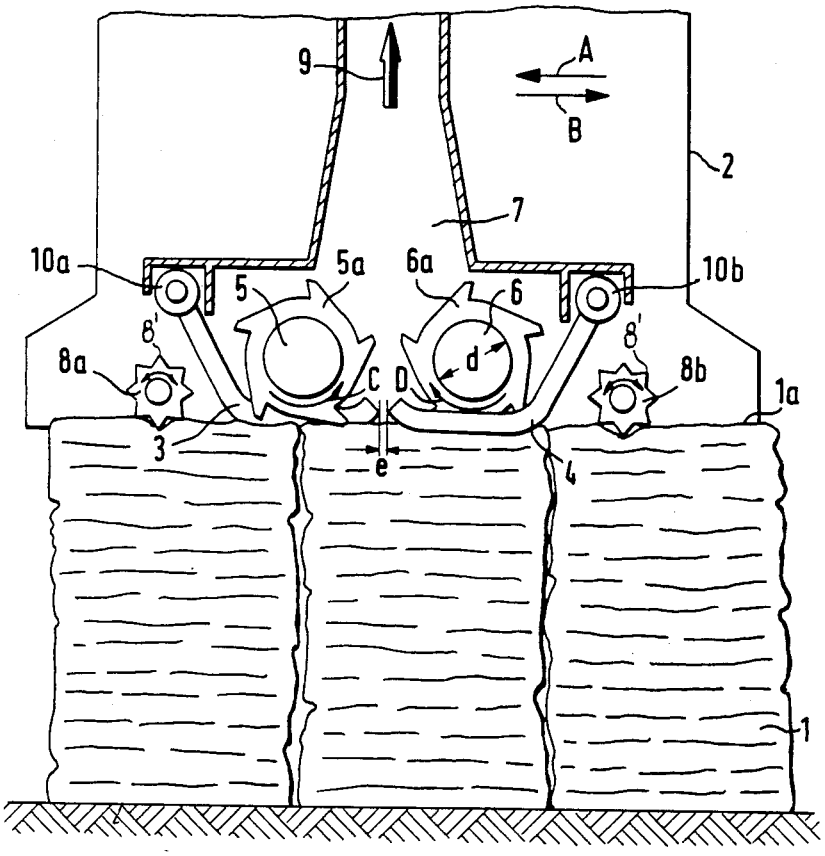
FIG. 1 is a schematic side elevational view of a preferred embodiment of the invention.
Figure 2:
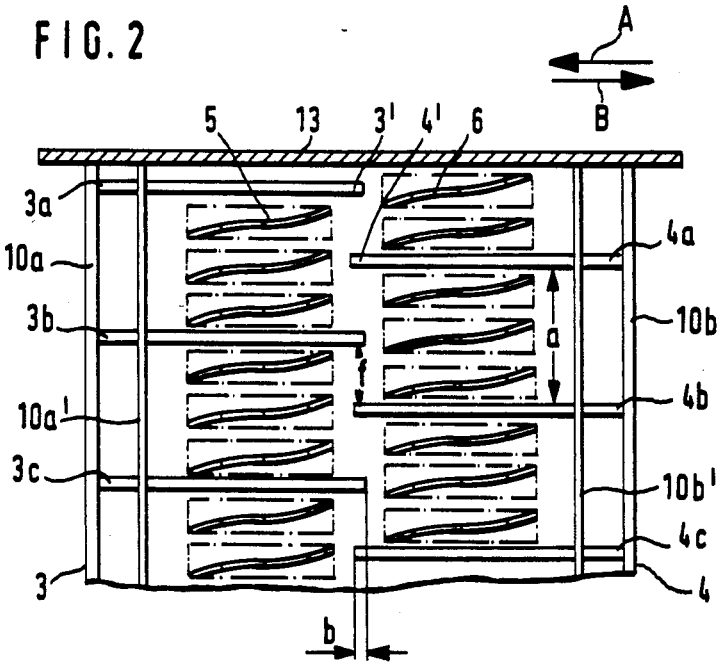
FIG. 2 is a schematic top plan view of some components of a modified embodiment of the invention.

Turning to FIG. 1 there are illustated fiber bales 1 positioned on the floor in a free-standing manner. A travelling bale opener carriage (not shown) movable on floor-supported rails along the fiber bales I supports an opening device which is vertically movable to adapt itself to the decreasing height of the fiber bales during operation and comprises a housing 2, two separate grates 3 and 4, two opening rollers 5 and 6 associated with the grates 3 and 4, respectively, and a suction hood 7. The bale opener and thus the opening device travels in the direction of arrows A or B. The grates 3 and 4 project through the clearances defined between circumferential teeth 5*a*, 6*a*, underneath the opening rollers 5 and 6 as also shown in FIG. 2. The diameter of the core of the opening rollers 5, 6, that is, the roller diameter less the radial height of the toothed discs or spikes thereon, is designated at d. The grates 3 and 4 lie on the top face la of the fiber bales 1 and thus function as hold-down devices. In front of and behind the opening rollers 5 and 6 there are arranged axially parallel pressing rollers 8*a*, 8*b* which function as supporting and hold-back rollers and which are pressed against the upper face 1*a* of the fiber bales 1. In this manner and by virtue of the penetration of the teeth 8' of the pressing rollers 8*a*, 8*b* the fiber bales 1 are immobilized and thus secured against shifting or tipping over. Further, the layers of the fiber bales 1 are secured against a horizontal tearoff by the opening rollers 5 and 6 or by the grates 3 and 4.

The direction of rotation of the opening rollers 5 and 6 is designated with arrows C and D. The opening rollers 5 and 6 thus rotate in their lower, working zone towards one another, that is, their direction of rotation is oriented inwardly. The suction hood 7 is positioned above the opening rollers 5, 6. During operation, the opening device, thus including the opening rollers 5, 6, travels above the free-standing fiber bales 1 back in forth and, at the same time, the opening rollers are rapidly rotated and their teeth 5*a*, 6*a* project through clearances between the grate bars of the grates 3 and 4 and penetrate into the fiber bale surface, detaching fiber tufts therefrom. The fiber tufts torn out of the upper face 1*a* of the fiber bales 1 by the opening rollers 5, 6 are inwardly hurled by these rollers and are introduced directly into the airstream 9 generated by a suction device (not shown) and drawn away through the hood 7.

Figure 3:
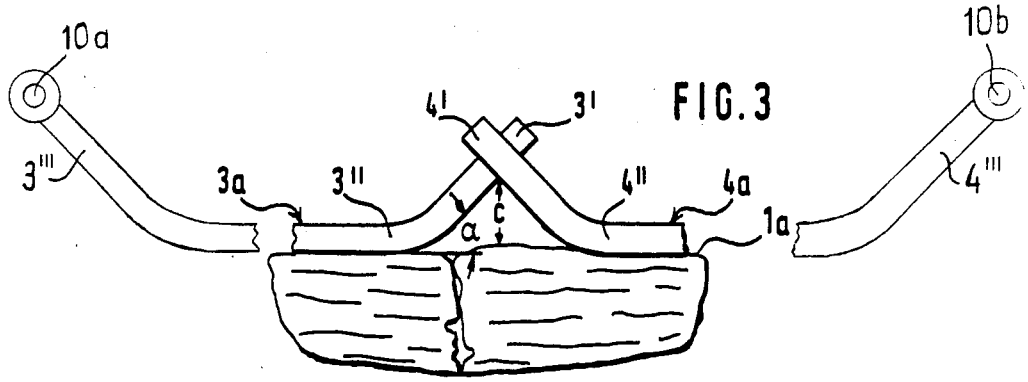
FIG. 3 is a schematic side elevational view of the structure shown in FIG. 2.

With particular reference to FIGS. 2 and 3, the grates 3, 4 are each formed of a plurality of grate bars 3*a*, 3*b*, 3*c* and 4*a*, 4*b*, 4*c*. Each grate bar has essentially three zones: a first end 3', 4'; a midzone 3'', 4'' and a second end 3''', 4'''. The first ends 3',4' are oriented at an angle $\alpha$ upward and away from the surface 1*a*, whereas the midzones 3'', 4'' engage the top face 1*a* of the fiber bales 1 in an essentially horizontal orientation. The second ends 3''', 4''' are at an angle to the upper face 1*a*. While the ends 3', 4' are open (that is, they are not connected to one another either directly or by a transverse member), the ends 3''', 4''' of the grate bars are secured to a transverse holding element 10*a*, 10*b*, respectively. The holding elements 10*a*, 10*b* are held in lateral vertical walls 13 (only one shown) of the opener housing 2. Each opening roller 5, 6 is associated with a separate, own grate 3 and 4, respectively, wherein the open ends 3', 4' of the grate bars 3*a*, 3*b* and 3*c* as well as 4*a*, 4*b* and 4*c* are directed towards one another. By an own grate 3 and 4 it is meant that the grates 3 and 4 are independent from one another, that is, between the open, facing ends 3', 4' of the grate bars 3*a*, 3*b*, 3*c* and 4*a*, 4*b*, 4*c* a clearance is provided. The open grate ends 3', 4' oriented towards one another are not connected mechanically with one another. In the FIG. 1 embodiment the open grate ends are spaced from one another at a distance d' parallel to the traveling direction A, B, while in the embodiment according to FIGS. 2 and 3 the overlapping grate bars are separated by a clearance l.

Referring once again to FIG. 2, the grate bars 3*a*, 3*b* and 3*c* as well as 4*a*, 4*b* and 4*c* of the grates 3 and 4 extend in parallel juxtaposition in a width direction of the upper face 1*a* of the fiber bales 1. Between the grate bars 3*a*, 3*b*, 3*c* and 4*a*, 4*b*, 4*c* there are shown schematically the opening rollers 5 and 6; their operational range (effect) on the top face 1*a* during rotation is indicated with dash-dot lines. The grate bars 3*a*, 3*b*, 3*c* are laterally offset with respect to the grate bars 4*a*, 4*b*, 4*c*. In this manner parallel crests obtained in the bale face by one opening roller will be levelled by the other opening roller. The outer ends 3''', 4''' of the grates 3, 4 have a distance from the opening rollers 5, 6. The distance a of the grate bars 3*a*, 3*b*, 3*c* to one another (and also the distance between adjoining grate bars 4*a*, 4*b*, 4*c*) transverse to the direction of motion A, B of the opening device is approximately 100 mm. The distance b of the adjoining ends 3', 4' of the grate bars 3*a*, 3*b*, 3*c* and 4*a*, 4*b*, 4*c* in the overlapping zone is approximately 40 mm. Abutment bars 10*a*' and 10*b*' extend parallel to the opening rollers 5 and 6 and are situated above the bars of the respective grates 3 and 4 for preventing the latter from colliding with the associated opening roller.

Referring once again to FIG. 3, the open ends 3', 4' of the grate bars 3*a* and 4*a* are arranged in an overlapping relationship. The distance between the overlap and the top face 1*a* of the bales is designated as c. The angle between the horizontal midzone 3'' of the grate bar 3*a* and the end zone 3' is designated at $\alpha$. The angle between the horizontal zone 4'' of the grate bar 4*a* or the top face 1*a* of the bale and the open terminal zone 4' is also $\alpha$.

Turning now to FIG. 4, there is shown a springing suspension of the grate 3. The grate 4 is similarly supported. The grate bars 3*a*, 3*b* and 3*c* are secured to the holding element 10*a* which, in turn, is resiliently secured by means of springs 11*a*, 11*b* to the carrier element 12. The grate bars 3*a*, 3*b* and 3*c* constitute an outer zone I which is joined by a midzone II, of which only one grate bar 3*d* is shown. The zone II may have a spring resiliency different from that of zone I.

Turning to FIG. 5, between the open ends 3', 4' of the grate bars 3*a*, 4*a* there is arranged a pressing roller 8*c* provided with teeth 8'. The outermost boundary line of the grate bars 3*a*, 4*a* in the zone of the second end 3''' and 4''' extends close to the opening rollers 5 and 6 so that the opening device may be moved in a vertical direction into gaps between two adjoining bales 1 of a fiber bale row. In this manner corner zones between adjoining bales 1 may be worked on.

Figure 6:
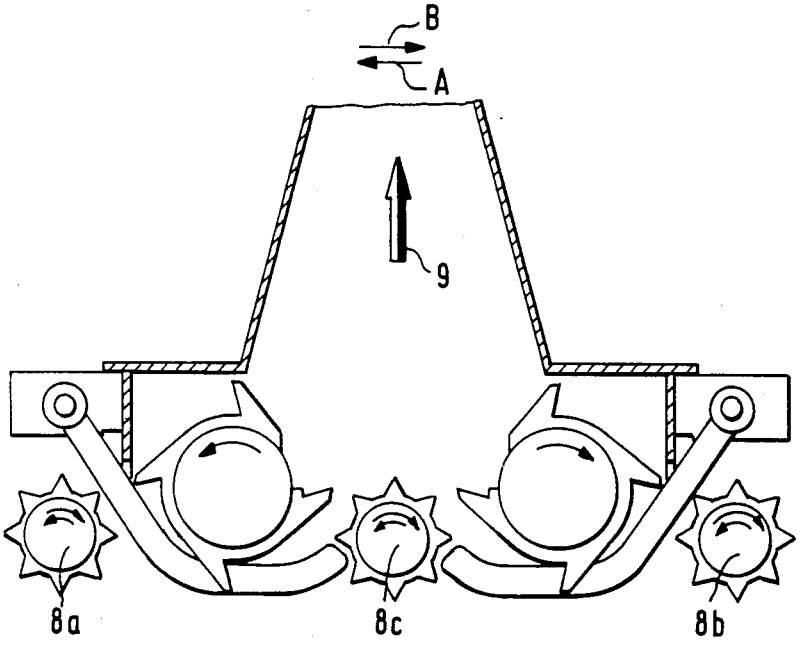
FIG. 6 is a schematic side elevational view of still another preferred embodiment of the invention.

FIG. 6 shows an embodiment in which two externally located pressing rollers 8*a*, 8*b* and one inside-located pressing roller 8*c* are used. The three pressing rollers 8*a*, 8*b*, 8*c* reliably ensure that the layers of the fiber bales as well as the entire fiber bales 1 are not shifted in an undesirable manner.

The present disclosure relates to the subject matter disclosed in Federal Republic of Germany Application Serial No. P 36 34 709.4 filed Oct. 11, 1986 and Federal Republic of Germany Application Serial No. P 37 22 201.5 filed July 4, 1987, the entire specifications of which are incorporated herein by reference.

It will be understood that the above description of the present invention is susceptible to various modifications, changes and adaptations, and the same are intended to be comprehended within the meaning and range of equivalents of the appended claims.

What is claimed is:

1. In a travelling opening device for detaching fiber material from top faces of fiber bales, including two opening rollers having generally horizontal longitudinal axes oriented perpendicularly to a travelling direction of the opening device; opening elements carried on the opening rollers; grates formed of grate bars spaced parallel to said longitudinal axes and each having a horizontal length portion arranged to engage the top faces of the fiber bales; said elements of the opening rollers projecting between said grate bars and arranged for penetrating into the fiber bales; the improvement wherein each said opening roller cooperates with a separate said grate; said grates being movably supported independently from one another; the grate bars of each grate having a supported end and an opposite free end spaced from said supported end parallel to the travelling direction; the free ends of the grate bars constituting an open end of the grate; the open ends of the two grates being adjacent and being oriented towards one another; the free end of each grate bar extending upwardly from said horizontal length portion, away from the top face of the bale during operation.

2. A travelling opening device according to claim 1, further comprising spring means for individually resiliently supporting said grate bars.

3. A travelling opening device according to claim 1, wherein the distance between consecutive grate bars of each said grate is approximately 100 mm.

4. A travelling opening device according to claim 1, further comprising a suction hood arranged above said open ends of the grates for removing fiber tufts detached by said opening rollers.

5. A travelling opening device according to claim 1, further comprising two pressing rollers supported for rotation in an orientation parallel to said opening rollers; said two pressing rollers together flanking said grates.

6. A travelling opening device according to claim 1, wherein the angle defined in each grate bar between the upwardly extending free end and the horizontal is approximately 35°–45°.

7. A travelling opening device according to claim 1, wherein the horizontal length portion of each said grate bar has a length generally corresponding to the diameter of one of said opening rollers.

8. A travelling opening device according to claim 1, wherein the length of the horizontal length portion of each said grate bar is about 50–70 mm.

9. A travelling opening device according to claim 1, wherein the length of the free end of each said grate bar is about 60–80 mm.

10. A travelling opening device according to claim 1, further comprising means for rotating the opening rollers in opposite directions such that in lower zones thereof the opening rollers rotate towards one another.

11. A travelling opening device according to claim 1, wherein the open end of one of said grates is spaced in the travelling direction from the open end of the other of said grates.

12. A travelling opening device according to claim 1, wherein the grate bars forming one of said grates are offset relative to the grate bars forming the other of said grates.

13. A travelling opening device according to claim 12, wherein said free ends of the grate bars forming said one grate are in an overlapping relationship with the free ends of the grate bars forming said other grate.

14. A travelling opening device according to claim 13, wherein the free ends of the grate bars forming said one grate and the free ends of the grate bars forming said other grate are at a distance of about 40 mm from one another, measured parallel to said travelling direction.

15. A travelling opening device according to claim 1, further comprising spring means for resiliently individually supporting each said grate.

16. A travelling opening device according to claim 15, wherein each said grate has a plurality of zones, each formed of a plurality of grate bars; each grate zone having separate spring means for individually resiliently supporting the grate zone.

17. A travelling opening device according to claim 16, wherein one of the zones is an inner zone and two of the zones are outer zones flanking the inner zone on both sides thereof; and further wherein the spring means of the inner grate zone has a hardness of resiliency different from those of the spring means of the outer grate zones.

18. A travelling opening device according to claim 1, further comprising a pressing roller supported for rotation in an orientation parallel to said opening rollers; said pressing roller being situated between the open ends of said two grates and being arranged for engaging the top of the fiber bales.

19. A travelling opening device according to claim 18, wherein the diameter of the pressing roller is about 100–150 mm.

20. A travelling opening device according to claim 19, wherein the pressing roller has a cylindrical surface provided with tooth-like fiber bale-engaging elements.

21. A travelling opening device according to claim 20, wherein said tooth-like fiber bale-engaging elements are arranged in axially spaced, circumferential series; and wherein the free ends of said grate bars extend into axial clearances between axially adjoining said tooth-like fiber bale-engaging elements.

* * * * *